US011421448B2

(12) United States Patent
Gómez García et al.

(10) Patent No.: US 11,421,448 B2
(45) Date of Patent: Aug. 23, 2022

(54) SYMMETRICAL AND REVERSIBLE-CLUTCH MORTISE LOCK

(71) Applicant: Salto Systems, S.L., Oiartzun (ES)

(72) Inventors: Sergio Gómez García, Oiartzun (ES); Carlos Ferreira Sánchez, Oiartzun (ES)

(73) Assignee: Salto Systems, S.L., Oiartzun (ES)

( * ) Notice: Subject to any disclaimer, the term of this patent is extended or adjusted under 35 U.S.C. 154(b) by 146 days.

(21) Appl. No.: 16/900,012

(22) Filed: Jun. 12, 2020

(65) Prior Publication Data

US 2020/0392761 A1 Dec. 17, 2020

(30) Foreign Application Priority Data

Jun. 14, 2019 (ES) ..... ES201930546

(51) Int. Cl.
*E05B 63/08* (2006.01)
*E05B 15/00* (2006.01)
(Continued)

(52) U.S. Cl.
CPC ..... *E05B 63/08* (2013.01); *E05B 15/0013* (2013.01); *E05B 15/04* (2013.01);
(Continued)

(58) Field of Classification Search
CPC ..... E05B 63/08; E05B 63/16; E05B 63/0056; E05B 63/0065; E05B 2047/0026; E05B 47/0603; E05B 47/0676; E05B 47/0684; E05B 47/0692; E05B 63/04; E05B 63/042; E05B 15/0013; E05B 2047/002; E05B 2047/0037; E05B 47/00; E05B 47/0001;
(Continued)

(56) References Cited

U.S. PATENT DOCUMENTS 6,145,353 A * 11/2000 Doucet ..... E05B 47/0692 70/149
7,353,674 B2 * 4/2008 Raatikainen ..... E05B 47/0688 70/277
(Continued)

FOREIGN PATENT DOCUMENTS

EP 2460957 A1 * 6/2012 ..... E05B 65/1086
ES 2326482 T3 10/2009
(Continued)

*Primary Examiner* — Christine M Mills
*Assistant Examiner* — Peter H Watson
(74) *Attorney, Agent, or Firm* — The Webb Law Firm

(57) ABSTRACT

The present invention relates to a symmetrical and reversible-clutch mortise lock comprising a central follower, a pair of symmetrical lateral followers, each one located on one side of the central follower to be activated by square bars of handles, a spacer which makes the movement of the two lateral followers independent and a motor, which connects to an actuation lever and which is activated when an access code is validated. The lock further comprises a clutch housed and guided in an accumulator arm able to move linearly to be housed in both lateral followers such that the corresponding lateral follower, when activated by the motion of the door handle, pushes the clutch until it makes contact with the central follower and activates the latch of the lock.

10 Claims, 8 Drawing Sheets

(51) Int. Cl.

| | |
|---|---|
| ***E05B 15/04*** | (2006.01) |
| ***E05B 47/06*** | (2006.01) |
| ***E05B 63/00*** | (2006.01) |
| ***E05B 63/04*** | (2006.01) |

(52) U.S. Cl.
CPC ..... *E05B 47/0684* (2013.01); *E05B 47/0692* (2013.01); *E05B 63/0056* (2013.01); *E05B 63/04* (2013.01); *E05B 2015/0406* (2013.01); *E05Y 2201/216* (2013.01); *E05Y 2201/224* (2013.01); *E05Y 2201/246* (2013.01); *E05Y 2201/248* (2013.01); *E05Y 2201/266* (2013.01); *E05Y 2201/43* (2013.01); *E05Y 2201/484* (2013.01); *E05Y 2201/626* (2013.01); *E05Y 2600/622* (2013.01); *E05Y 2600/634* (2013.01)

(58) Field of Classification Search
CPC ..... E05B 47/0012; E05B 47/06; E05C 1/00; E05C 1/002; E05C 1/08; E05C 1/085; E05C 1/12; E05C 1/16; Y10T 292/1016; Y10T 292/102; Y10T 292/0967; Y10T 292/096; Y10T 292/0994; Y10T 292/0977; Y10T 292/0982
See application file for complete search history.

(56) References Cited

U.S. PATENT DOCUMENTS

| | | | | |
|---|---|---|---|---|
| 8,201,858 | B1 * | 6/2012 | Moon | E05B 15/0013 292/164 |
| 8,292,336 | B2 * | 10/2012 | Moon | E05B 55/00 292/61 |
| 8,671,723 | B2 * | 3/2014 | Dayanikli | E05B 47/0673 70/278.7 |
| 2010/0263418 | A1 | 10/2010 | Moon | |

FOREIGN PATENT DOCUMENTS

| | | | | | |
|---|---|---|---|---|---|
| ES | 2498892 | B2 | | 9/2014 | |
| GB | 2459006 | A | * | 10/2009 | E05B 63/04 |
| KR | 20090004379 | U | * | 5/2009 | |
| WO | WO-2004088069 | A1 | * | 10/2004 | E05B 63/16 |
| WO | WO-2006016826 | A2 | * | 2/2006 | E05B 47/0002 |

* cited by examiner

SYMMETRICAL AND REVERSIBLE-CLUTCH MORTISE LOCK

CROSS-REFERENCE TO RELATED APPLICATION

This application claims priority to Spanish Patent Application No. P201930546 filed Jun. 14, 2019, the disclosure of which is hereby incorporated by reference in its entirety.

BACKGROUND OF THE INVENTION

Field of the Invention

The object of the present invention is a mortise lock which has a reversible clutch system and the configuration of which further provides it with optimal security features against possible manipulation attempts.

The lock object of the invention is applicable in the locksmithing industry, specifically in locksmithing for doors with access control.

Description of Related Art

Currently, mortise locks, of the type used to allow only authorised persons to pass, have a clutch mechanism, such that in a disengaged position the handle of the lock moves without actuating the latch, and therefore without opening the door, meanwhile when it is in an engaged position, because the access code, the key or other system has been introduced actuating the clutch, by rotating the handle, the latch moves and therefore the door opens.

Furthermore, it must be taken into account that the operation of the handle depends on the position thereof with respect to the inside or outside of the room that it locks. In other words, the handle located on the outer side of the door of the room or space it protects, e.g., the one facing the hallway or the street, operates such that said handle is always disengaged, so that it does not actuate the latch when rotated unless it is by means of the introduction of the correct key, access code, card or similar, which will activate the clutch and therefore when rotating the handle, the latch will be actuated.

However, the handle that is on the inner side of the room has the function of always being able to actuate the latch when rotated, in order to enable the exit from the room without having to introduce any key. This situation takes place, for example, in hotels.

Depending on whether the door opens to the right or to the left, the operation of the handles is inverted, such that it is necessary to have a system which enables the internal operation of the lock to be altered.

Furthermore, it is important that the clutch system designed in these locks provides maximum security against manipulation attempts of an unauthorised opening of the lock and is able to address anomalous operational situations.

Several documents are known which disclose locks that are similar to the lock object of the invention. Among the known documents, it is worth noting document US2010/0263418A1 which discloses a mortise lock with a reversible clutch comprising a part which enables the outer handle to behave as an inner handle and vice versa, installing said concentric-shaped part in the parts on the inside of the lock, which are in turn joined to the shafts of the handles, respectively.

Document ES2326482T3 is also known which discloses a lock with controllable handle actuation. The lock of this document tries to provide a solution which offers a wide range of possibilities for installing and using the lock such that it can always be used from one side of the door and the use from the other side is selectively controlled. In this document, the casing of the lock, when installed in the door, should be convertible such that it can be used in the door regardless of the direction in which the door is to be rotated. Additionally, in this lock the changes in the casing can be made by means of the installation device.

Finally, the applicant also knows document ES2498892B2 which discloses a tilt clutch lock having a spring with elastic accumulation which enables the change to be made so that the outer handle behaves like the inner handle and vice versa.

None of the documents known to the applicant has a system that allows the change in operation of the handle to be carried out in a quick and simple manner and that further offers security guarantees against unwanted manipulation of the lock such as those offered by the lock disclosed in this document.

SUMMARY OF THE INVENTION

In order to achieve the objectives and avoid the aforementioned drawbacks, the present invention describes a symmetrical and reversible-clutch mortise lock comprising a central follower, a pair of symmetrical lateral followers, each one located on one side of the central follower, a spacer which makes the movement of the two lateral followers independent and a motor joined to a transmission system that engages with a toothed end of an actuation lever. This actuation lever further comprises a cylindrical projection wherein a torsion accumulator spring with free rotation and two legs is housed, and a prismatic projection.

The lock of the invention further comprises an accumulator arm and a clutch as main elements. The accumulator arm is made up of a body comprising a pair of forks for housing and guiding, two guide points, located on both sides of the accumulator arm one after the other, a guide groove and a push point. The clutch is configured by means of a central web and two projections. The clutch is configured to be housed and guided by the accumulator arm, such that each projection of the clutch rests on a fork of the accumulator arm. In addition, the lateral follower comprises a push element, intended for moving the clutch, and a stop, which limits the motion of the lateral follower by actuating on the clutch.

The guide points and the guide groove of the accumulator arm are coupled on additional guide grooves and an additional guide point, located in a support, fixed to the lock structure, which make the linear movement of the accumulator arm possible.

The push point of the accumulator arm and the prismatic projection of the actuation lever make contact with respective legs of the torsion accumulator spring, causing and in turn limiting the motion of the accumulator arm.

The cylindrical projection of the actuation lever is joined to the additional guide point, the actuation lever being able to rotate around the cylindrical projection.

The push element of the lateral follower is configured to actuate on the central web of the clutch, remove the clutch from the accumulator arm and move the clutch until it makes contact with the central follower and activates the latch of the lock.

The forks of the accumulator arm can have an L-shaped configuration, such that they are joined to the body of the accumulator arm by means of one of the flanges, forming a fork base for supporting the projections of the clutch, while the other flange presents an inclined inlet surface to facilitate the introduction of the clutch.

Furthermore, the projections of the clutch can further have an inclined surface to facilitate the introduction of the clutch in the accumulator arm.

In order to prevent the interference of the lateral follower with one of the forks of the accumulator arm, the lateral follower preferably comprises a recess wherein the fork can be housed.

To activate the latch, the central follower preferably comprises a push element where the clutch makes contact.

The lock enables that, when desired, the door can open from one side without the need to validate any identification, in other words, it can always take place. To do this, the central follower comprises two cylindrical holes located in alignment with elongated holes of the central follower for the placement of at least one handling-selector pin which fix the lateral follower to the central follower and which enable the direct activation of the door latch from the side where the lateral follower which is fixed to the central follower is located. To carry out this fixing, a single pin or both pins can be introduced, for security reasons. In another embodiment, the pins can be incorporated into an annular part such that the introduction and extraction thereof is facilitated.

Furthermore, the lock can comprise a positioning spring, fixed to the support of the lock structure and to a spring guide which makes contact with a projection of the lateral follower. In this way, by releasing the door handle, the lateral follower is returned to the resting position thereof.

BRIEF DESCRIPTION OF THE FIGURES

To complete the description of the invention, and for the purpose of helping to make the features thereof more readily understandable, according to a preferred exemplary embodiment thereof, a set of drawings is included where, by way of illustration and not limitation, the following figures have been represented.

Figure 1:
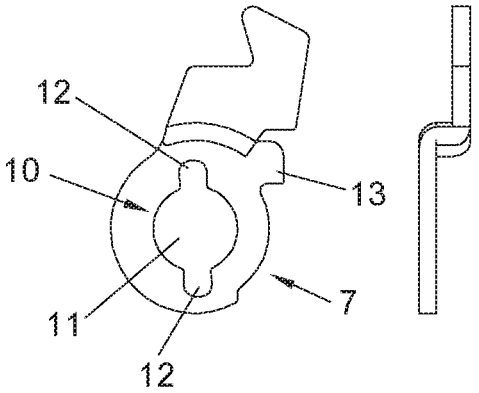
FIG. 1 shows a frontal view and a side view of a central follower.

A list of the references used in the figures is provided below:

1. Actuation lever.
2. Accumulator arm.
3. Torsion accumulator spring.
4. Clutch.
5. Handling-selector pin.
6. Spacer.
7. Central follower.
8. First lateral follower.
9. Second lateral follower.
10. Central hole.
11. Circular hole.
12. Elongated holes.
13. Drag element.
14. Quadrangular hole.
15. Square bar of the handle.
16. Cylindrical holes.
17. Push element.
18. Cylindrical protrusion.
19. Recess.
20. Stop.
21. Projection.
22. Guide point.
23. Guide groove.
24. Toothed end.
25. Cylindrical projection.
26. Prismatic projection.
27. Legs of the torsion accumulator spring.
28. Central web.
29. Projection.
30. Inclined surface.
31. Support.
32. Additional guide point.
33. Additional guide groove.
34. Fork base.
35. Inlet surface.
36. Push point.
37. Fork.
38. Motor.
39. Spring guide.
40. Positioning spring.
41. Latch.
42. Rotation stop.
43. Annular part with pins.

DESCRIPTION OF THE INVENTION

Taking into consideration the adopted numbering in the figures, a preferred embodiment is described below, in a manner that provides greater clarity to the contents of the present specification.

The object of the present invention is a mortise lock which has a symmetrical and reversible clutch system and a robust configuration that provides it with maximum security against manipulation attempts.

The lock object of the invention comprises the following main elements that will each be described later on, further indicating the manner of actuation with each other to make up the whole of the invention:

a central follower (7),
lateral followers (8, 9),
an actuation lever (1),
a clutch (4), and
an accumulator arm (2).

The central follower (7) has the function of actuating the latch (41) of the lock. As shown in FIG. 1, it has a geometry incorporating a central hole (10) which is made up of a circular hole (11) and two elongated holes (12), joined to the circular hole (11), of smaller dimensions and diametrically opposed. It further incorporates a drag element (13) and an end by means of which the opening of the lock is actuated. The functionality of these components will be seen further on.

Figure 2:
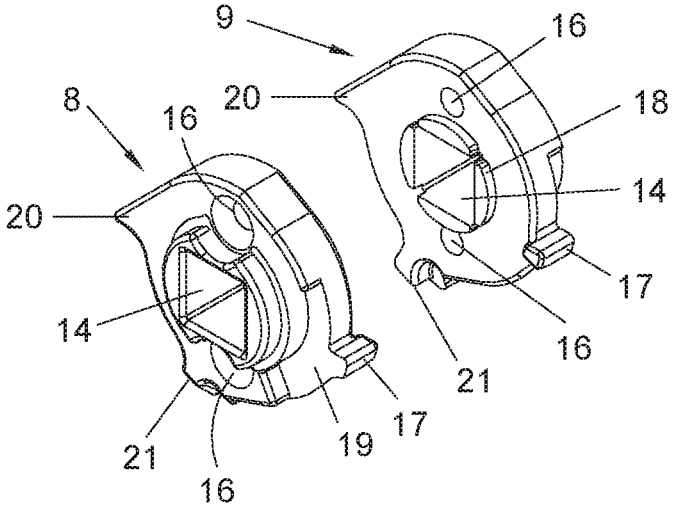
FIG. 2 shows a perspective view of two lateral followers in their relative position.
Figure 3:
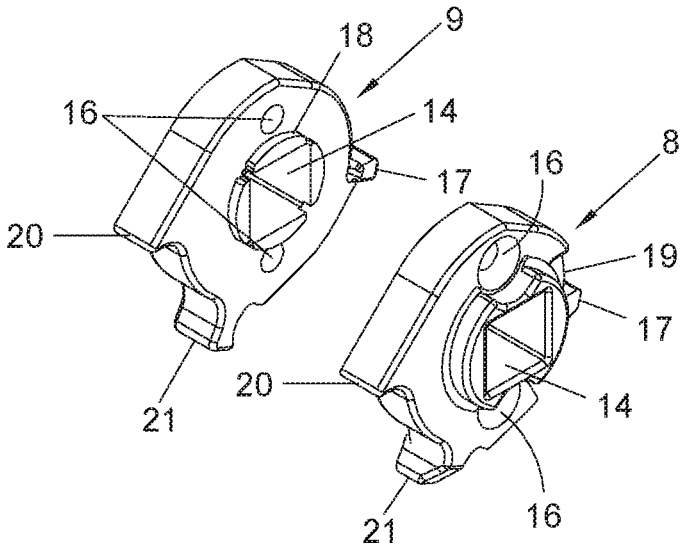
FIG. 3 shows a view from another perspective of the two lateral followers shown in FIG. 2.
Figure 18:
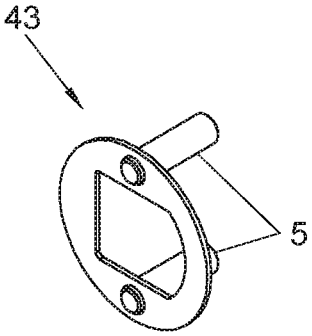
FIG. 18 shows a perspective view of two pins integrally assembled in an annular part.

The lateral followers (8, 9) are symmetrical and are symmetrically placed on each side of the central follower (7). As shown in FIGS. 2 and 3, in the central area thereof they incorporate a quadrangular hole (14), wherein a square bar (15) of a handle is inserted, as will be described further on. The square bars (15) are the shafts of the handles, having a square cross-section, by means of which the rotation motion is transmitted when the handles are actuated to open a door. In two opposite sides of the quadrangular hole (14), the lateral follower (8, 9) incorporates respective cylindrical holes (16) intended for the location of handling-selector pins (5), the function of which is to determine whether the handle opens the door without the need for identification, depending on the side where the lateral follower (8, 9) is, wherein the handling-selector pins (5) are introduced. In this way, it can be determined that the two sides of the door or only one, need identification in order to open, depending on the lateral follower (8, 9) on which the handling-selector pins (5) are placed, further making it possible that the same lock serves to open a door to the right or to the left simply by changing the handling-selector pins (5) from one lateral follower (8, 9) to the other one. Each one of the pins (5) is inserted into the respective cylindrical hole (16) of the lateral follower (8, 9) and fits in the elongated hole (12) of the central follower (7), which is aligned. In this way, the motion of the lateral follower (8, 9) and the central follower (7) is integrated. It can be noted that the motion is integrated with the inclusion of a single pin (5) although, for security reasons, it is preferable to insert both pins (5). Likewise, an annular-shaped part can be used, in order to save the quadrangular hole (14), which incorporates both pins (5), according to that shown in FIG. 18.

The lateral follower (8, 9) further incorporates a push element (17), a recess (19), a stop (20), a projection (21) and a cylindrical protrusion (18). The function of this cylindrical protrusion (18) is to facilitate the positioning and the rotation of the lateral followers (8, 9) on the central follower (7). For this purpose, the cylindrical protrusion (18) of each lateral follower (8, 9) is inserted into the central hole (10) of the central follower (7), each one on one side, leaving a space between them where a spacer (6) is located, the functionality of which is to separate the square bars (15) from the lock handles and therefore to make the opening motion independent, by means of the handles, from the two sides of the door. In this way, by rotating the handle to open the door, the square bar (15), the corresponding lateral follower (8, 9) and the central follower (7) if it is connected are rotated, whether by means of the handling-selector pins (5) or by means of the clutch (4), as will be seen further on, are rotated. The rotation causes an end of the central follower (7) to activate the opening of the lock.

Figure 14:
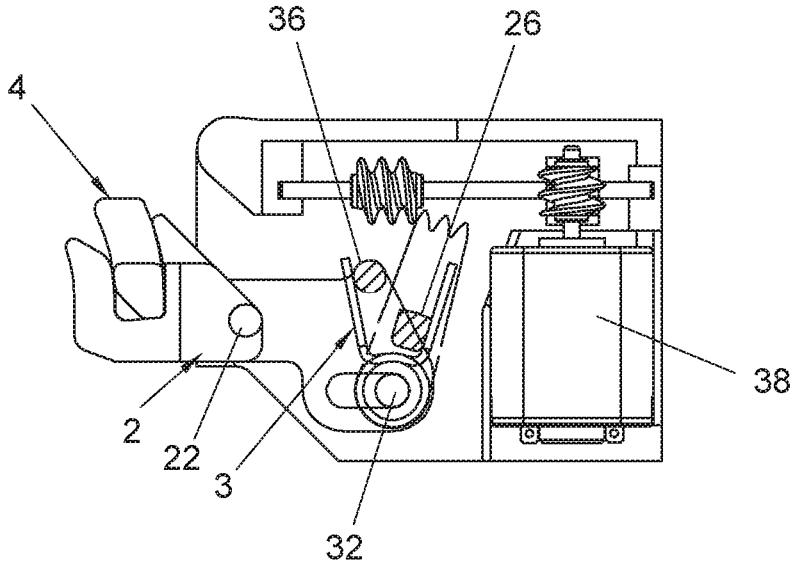
FIG. 14 shows a sectional view of the lock components in a situation immediately subsequent to that shown in the preceding figure.
Figure 15:
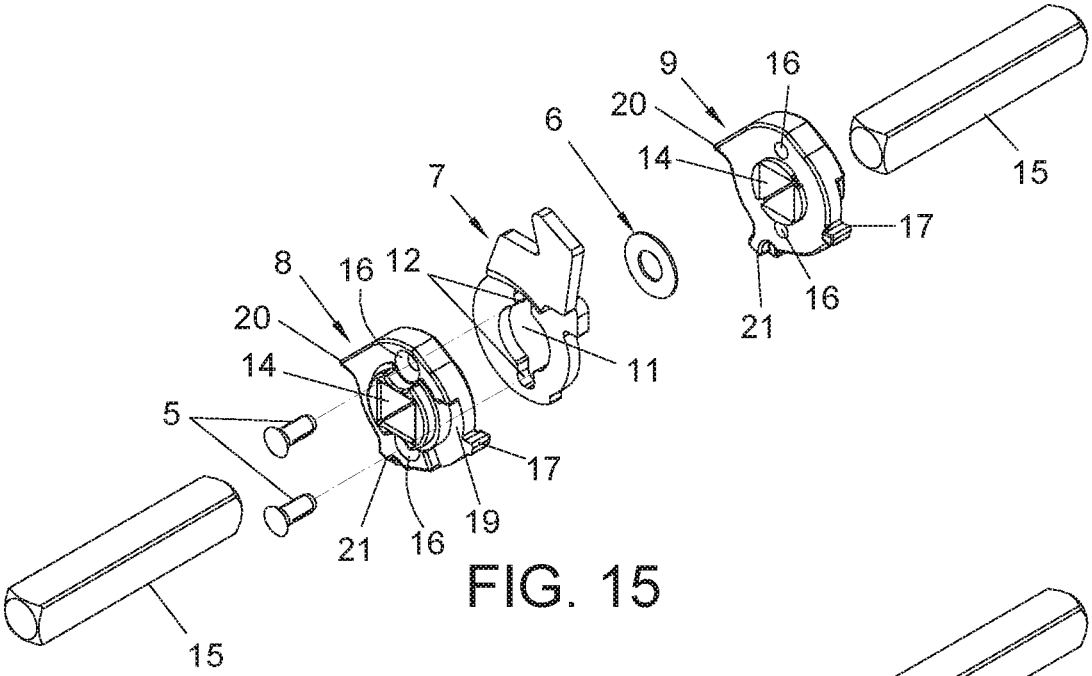
FIG. 15 shows an exploded view of the components responsible for fixing the lateral follower to the central follower from the inner side of the door (left side of the exploded view).

A representation of all these elements can be seen in FIGS. 14 and 15, wherein the different elements that participate in the mechanical motion when the handle is rotated in the opening situations from one side or from the other side of the door are exploded. This is due to the fact that the most common situation, although not exclusive, is that the door can always open from inside the room without the need for any key, while from the outside it is necessary to use a key or similar means of identification for access.

Figure 4:
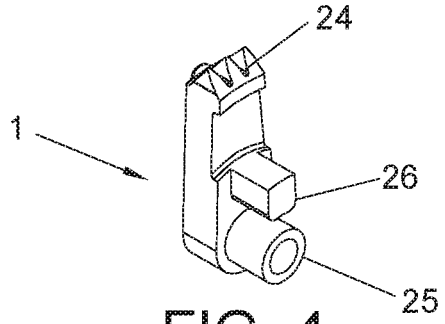
FIG. 4 shows a perspective view of an actuation lever.

FIG. 4 shows an actuation lever (1), having a toothed end (24), a cylindrical projection (25) with a hole and a prismatic projection (26).

Figure 5:
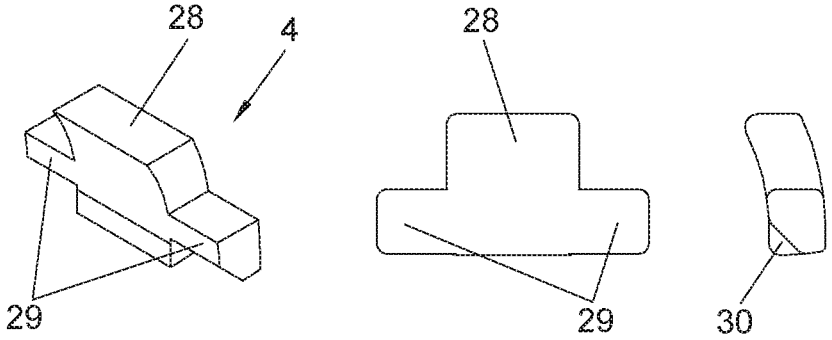
FIG. 5 shows a perspective view, frontal view and side view of a clutch.

FIG. 5 shows a clutch (4). It is made up of a central web (28) and two projections (29) incorporating respective inclined surfaces (30). It has a curved configuration to adapt to the geometry of the central follower (8, 9), as will be described further on.

Figure 6:
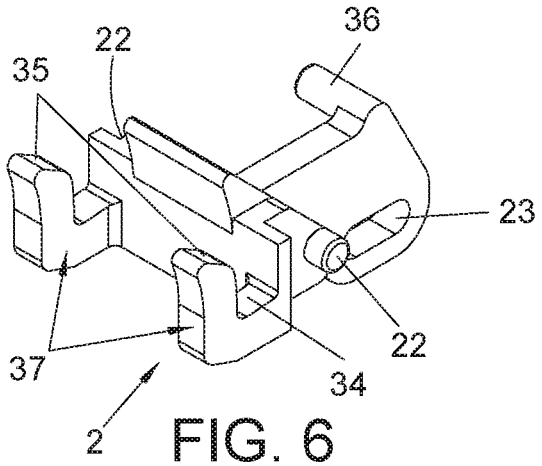
FIG. 6 shows a perspective view of an accumulator arm.

FIG. 6 shows an accumulator arm (2) configured by means of two ends which are joined to a central body wherein guide points (22) are located. One of the ends is made up of two forks (37) with an L-shaped configuration which are joined to the central body by means of one of the flanges thereof, which act by way of fork bases (34). The other ends of the forks (37) end in inlet surfaces (35).

The accumulator arm (2) is intended for housing, guiding and moving the clutch (4), such that it fits in the free space formed between the central body and the free flanges of the forks (37), the projections (29) of the clutch (4) resting on the fork bases (34).

The function of the inlet surfaces (35) of the accumulator arm (2) is to retrieve the clutch (4) facilitating the insertion of the projections (29) of the clutch (4) into the fork bases (34) of the forks (37) and thus positioning the clutch (4) in the accumulator arm (2). In order to perform this insertion effect, the projections (29) of the clutch (4) present inclined surfaces (30) in a position that will interfere with the inlet surfaces (35) of the accumulator arm (2).

Figure 7:
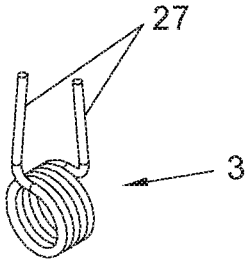
FIG. 7 shows a perspective view of a torsion accumulator spring.

The other end of the accumulator arm (2) incorporates a push point (36), where one of the legs (27) of a torsion accumulator spring (3) rests, such as that shown in FIG. 7, and a guide groove (23) which, together with the guide points (22), cause the accumulator arm (2) to have linear motion with movement over a support (31), fixed to the lock structure, wherein an additional guide groove (33) is located, which complements the guide points (22) of the accumulator arm (2), and an additional guide point (32), which complements the guide groove (23) of the accumulator arm (2).

In the additional guide point (32) of the support (31) the cylindrical projection (25) of the actuation lever (1) is fixed by means of the hole it incorporates, such that the actuation lever (1) is fixed to the support (31) of the lock structure with the sole possibility of rotation around said cylindrical projection (25).

For greater clarity, the two lateral followers (8, 9) will be differentiated in a first lateral follower (8), corresponding to the outer side of the room, from where means of identification is necessary to open, and a second lateral follower (9), corresponding to the inner side of the room, from where it is typically possible to open the door without the need for means of identification.

Figure 8:
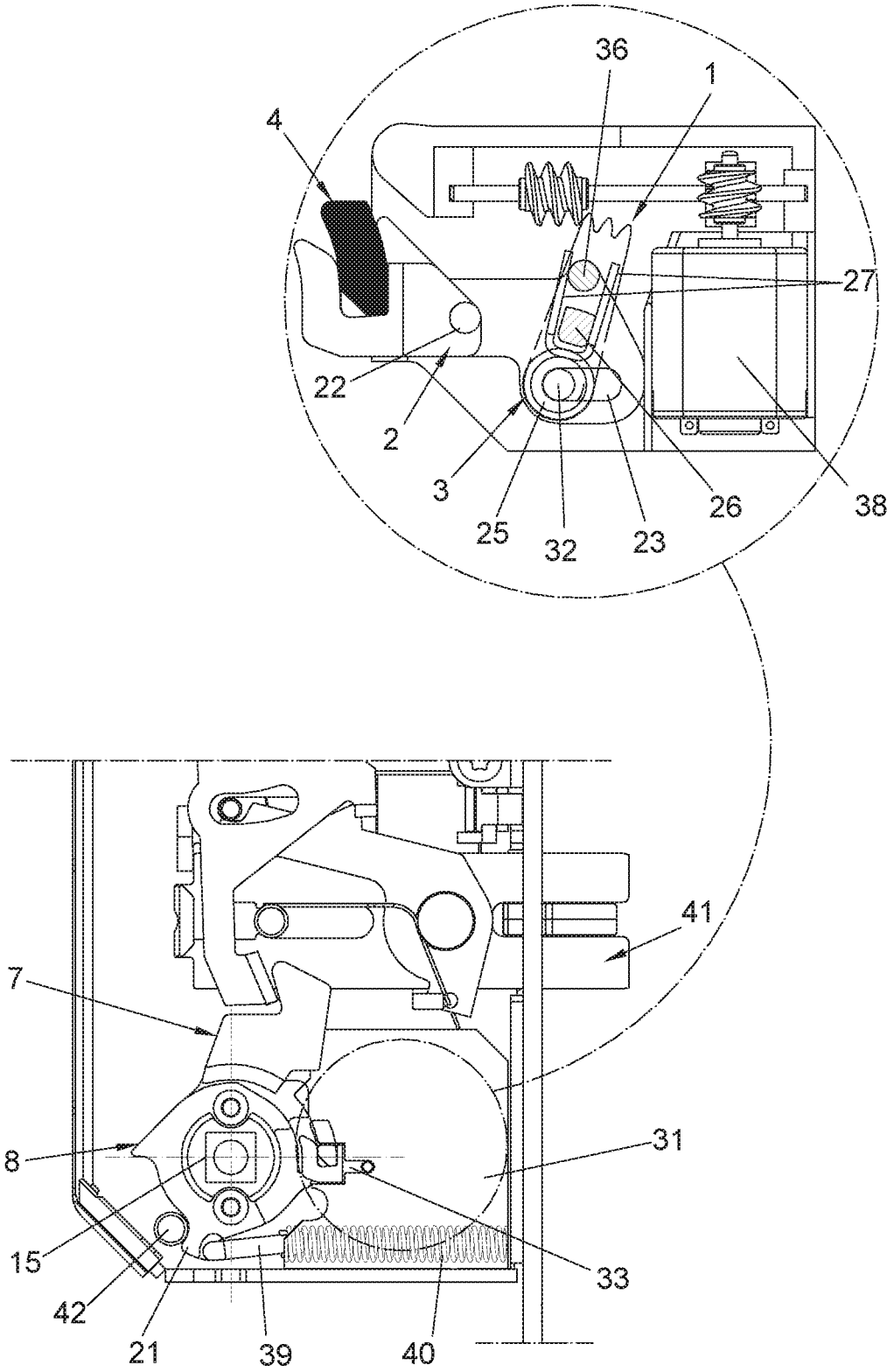
FIG. 8 shows a cross-sectional view with an enlarged detail of the lock of the invention in a disengaged position, with the clutch withheld against unauthorised openings.

FIG. 8 shows a side cross-sectional view of the mortise lock from the outer side, the side that needs validation of identification in order to open, with an enlargement wherein the details of the components are shown, wherein all the assembled parts at the time that the lock is disengaged can be seen. In this position, by rotating the handle, not shown in the figure, the square bar (15) would rotate and the latch (41) would not be actuated, as the system is disengaged. This is due to the fact that, by rotating the handle, the accumulator arm (2) is in the resting position thereof, e.g., out of the first lateral follower (8), so that the first lateral follower (8) would rotate over the central follower (7) but without moving it.

Figure 9:
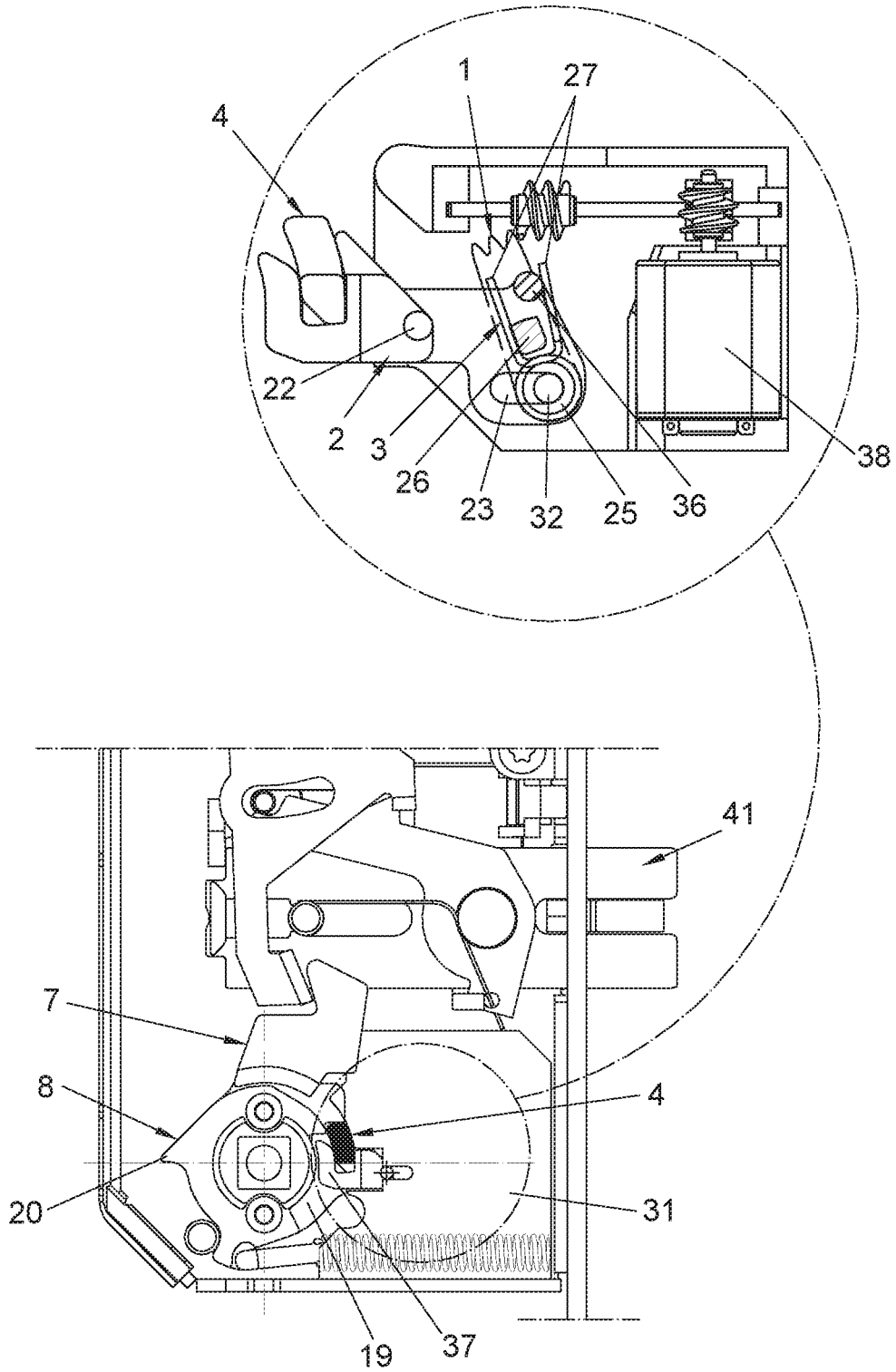
FIG. 9 shows the area of the followers of a lock in an engaged state, as stage subsequent to that shown in FIG. 8, wherein it can be seen that the accumulator arm, together with the clutch, has been moved towards the lateral follower.
Figure 10:
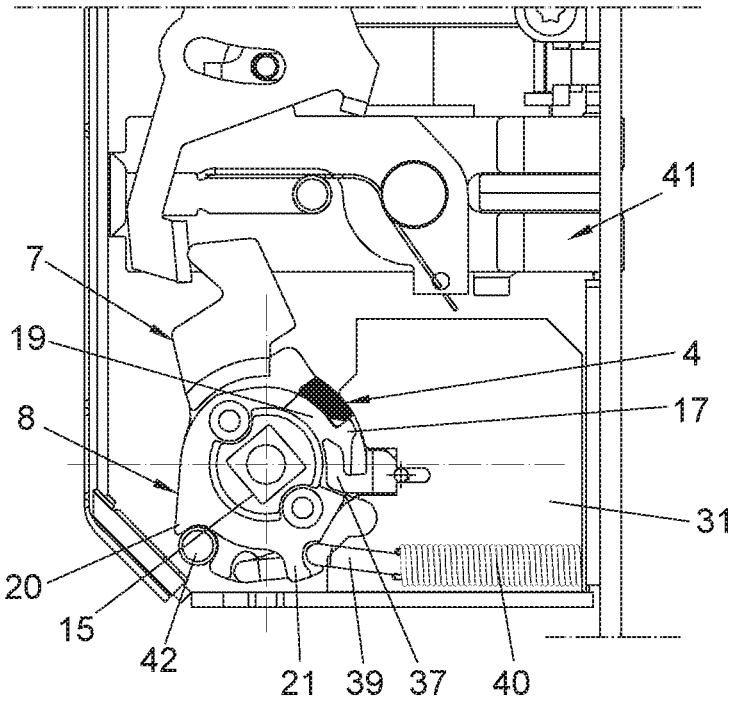
FIG. 10 shows the area of the followers of a lock in an engaged state with the clutch moved upon rotating the handle, opening the door.

The process of opening the lock from the outer side of the room will be described below and is shown in FIGS. 9 and 10.

Once the key is introduced in the lock, whether it is a code, a card or any other similar element, if the electronic system incorporated by the lock detects that it is the correct key, it sends a signal to a motor (38), which is activated, and, by means of a transmission system, it actuates the toothed end (24) of the actuation lever (1) causing it to rotate around the cylindrical projection (25).

As shown in the detail of FIG. 8, in an initial phase the prismatic projection (26) of the actuation lever (1) is in contact with the first leg (27) of the torsion accumulator spring (3), whereas the second leg (27) of the spring (3) abuts against the push point (36) of the accumulator arm (2).

The detail in FIG. 9 shows how, by rotating the actuation lever (1) by the effect of the motion of the transmission system via the activation of the motor (38), the prismatic projection (26) of this lever (1) has also rotated to make contact with the second leg (27) of the torsion accumulator spring (3) and push it, causing it to rotate around the cylindrical projection (25) of the actuation lever (1) wherein it is housed and causing the first leg (27) of the spring (3) to make contact with the push point (36) of the accumulator arm (2) and push it, causing the movement of the accumulator arm (2) and also of the clutch (4) which is housed therein, towards the interior of the lateral followers (8, 9). This movement, in the direction of the guide groove (23), is performed by means of the guide system made up of the guide points (22) of the accumulator arm (2) with the additional guide groove (33) existing in the support (31) and the guide groove (23) of the accumulator arm (2) with the additional guide point (32) of the support (31) wherein the cylindrical projection (25) is further located.

At this time, as shown in FIG. 10, when the clutch (4) is inside the lateral followers (8, 9), by rotating the handle, the square bar (15) causes the first lateral follower (8) to rotate, causing the push element (17) to press on the central web (28) of the clutch (4) to move it, removing it from the accumulator arm (2), moving it along the curved surface of the first lateral follower (8). In this rotation, the central web (28) of the clutch (4) makes contact with the drag element (13) of the central follower (7), causing it to rotate and make contact with the transmission of the door latch (41), causing it to retract towards the interior of the lock and opening it.

The recess (19) of the first lateral follower (8) allows the rotation thereof in the engaged position without it colliding with the fork (37) of the accumulator arm (2), until the stop (20) of the first lateral follower (8) makes contact with a rotation stop (42) located in the lock structure, limiting the rotation of the first lateral follower (8) during the opening.

Likewise, during the rotation, the projection (21) of the first lateral follower (8) actuates on a spring guide (39), which in turn compresses a positioning spring (40), which is fixed to the support (31) and therefore, to the lock structure.

Once the handle is released, the positioning spring (40) presses, by means of the spring guide (39), on the first lateral follower (8), returning it to the initial resting position thereof, the clutch (4) being introduced again in the accumulator arm (2) with the opposite motion to that described.

When a closure operation is performed, for example, once a scheduled time has passed since the opening or when a sensor detects that the handle has lifted, the accumulator arm (2) withdraws to the resting position thereof, activated by the motion of the motor (38) by means of the transmission system, the torsion accumulator spring (3) and the guide systems which exist between the accumulator arm (2) and the support (31) inversely to that previously described.

Figure 11:
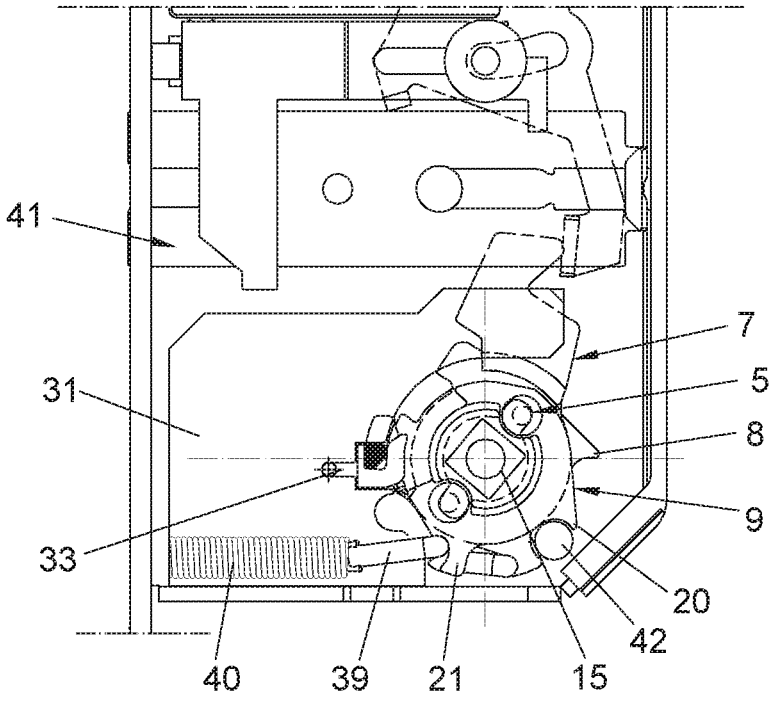
FIG. 11 shows a cross-sectional view of the lock of the invention to open from one side of the door without the need for identification.

FIG. 11 shows the opening of the lock from the inner side of the room.

In this case, the door can be opened from this inner side of the room without the need for any key or for introducing any code, card or similar. For this to take place, handling-selector pins (5) are introduced in the cylindrical holes (16) of the second lateral follower (9), which are aligned with the elongated holes (12) of the central follower (7), causing the second lateral follower (9) and the central follower (7) to make up a single component.

Thereby, by rotating the handle inside the room with the respective square bar (15) thereof, the assembly made up of the second lateral follower (9) and the central follower (7) is rotated, enabling the door to open regardless of the position of the clutch (4).

Furthermore, by rotating the second lateral follower (9), the projection (21) thereof is made to actuate on the spring guide (39) which, in turn, compresses the positioning spring (40), also installed in the support (31). Note there are two spring guides (39) and two positioning springs (40), one for each lateral follower (8, 9).

In this case, the first lateral follower (8) remains disengaged, with the clutch (4) and the accumulator arm (2) in a resting position, in other words, the door cannot be opened from the other side of the lock.

Figure 16:
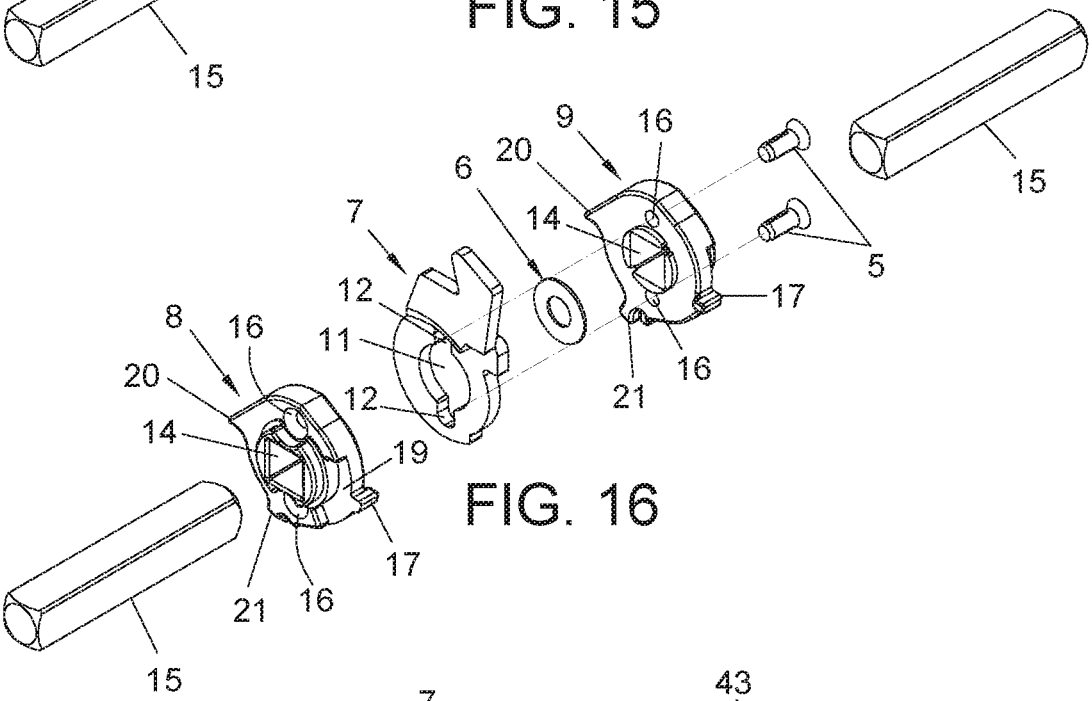
FIG. 16 shows an exploded view of the components responsible for fixing the lateral follower to the central follower from the inner side of the door (right side of the exploded view).
Figure 17:
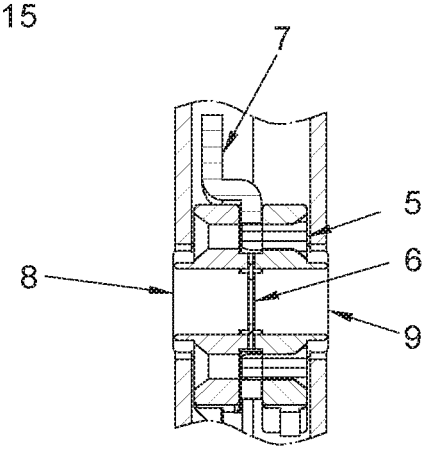
FIG. 17 shows a cross-sectional view of the lock components shown in FIG. 15 once assembled.

As can be seen in FIGS. 15, 16 and 17, the square bars (15) are independent by means of the use of a spacer (6), actuating the handle, either the inner or the outer handle, on the corresponding square bar (15) thereof.

Once the handle is released, the positioning spring (40) presses, with the spring guide (39), on the second lateral follower (9) returning it to the initial position thereof.

In this case in which the second lateral follower (9) is joined to the central follower (7) by the handling-selector pins (5), when the lock is engaged by means of the first lateral follower (8) associated with the outer side of the room, during the opening motion, the clutch (4), moved by the first lateral follower (8), drags the central follower (7) and the central follower (7) moves the second lateral follower (9), as it is joined thereto with the pins (5).

However, when the lock is disengaged, by rotating the handle on the outer side of the room, the first lateral follower (8) does not move the central follower (7), as the clutch (4) is not in an operative position with respect to the first lateral follower (8), such that there is no way to open the lock from the outer side of the room.

Likewise, during the opening from the inner side, as the system is not engaged, the clutch (4) is in the resting position thereof, i.e., outside of the lateral followers (8, 9), so that the motion of the second lateral follower (9) from the inner side does not act on the clutch (4) and, if the handling-selector pins (5) were not present, the door would not open.

Furthermore, in the event that the lock handling is to be changed, it will be enough to change the handling-selector pins (5) from the second lateral follower (9) to the first lateral follower (8) as shown in FIG. 15 with respect to FIG. 16. Therefore, the operation of the lock will be inverted, such that the second lateral follower (9) of FIG. 15 will always be disengaged until an identification is validated, whereas the first lateral follower (8) will allow the door to open simply by rotating the handle.

FIG. 17 shows a lateral cross-section of the device, wherein the two lateral followers (8, 9) corresponding to the outer and inner areas of the room can be differentiated, where the difference is made by the existence of the handling-selector pins (5). It can further be differentiated that, just by changing the handling-selector pins (5) to the other side, the inner side will become the outer one and vice versa. This situation is also the one that would be used so that the lock of a door that opens to the left can be used in a door that opens to the right, as mentioned.

There is also the possibility that the handling-selector pins (5) are not installed in the lock. Therefore, access from both sides of the lock would be restricted, in other words, both lateral followers (8, 9) would be disengaged and the opening of the door would solely take place by validating an identification by introducing a correct code, card or similar element. In this case, the movement of the clutch (4) would be solely performed by the lateral follower (8, 9) that would be activated by the system upon introducing the correct access element from the corresponding side.

Therefore, the lock of the invention is reversible, making it possible to change from one hand to the other or even to limit access to both sides of the lock by means of the handling-selector pins (5).

The mortise lock of the present invention further has a configuration that enables it to keep working correctly in anomalous operational situations.

Figure 12:
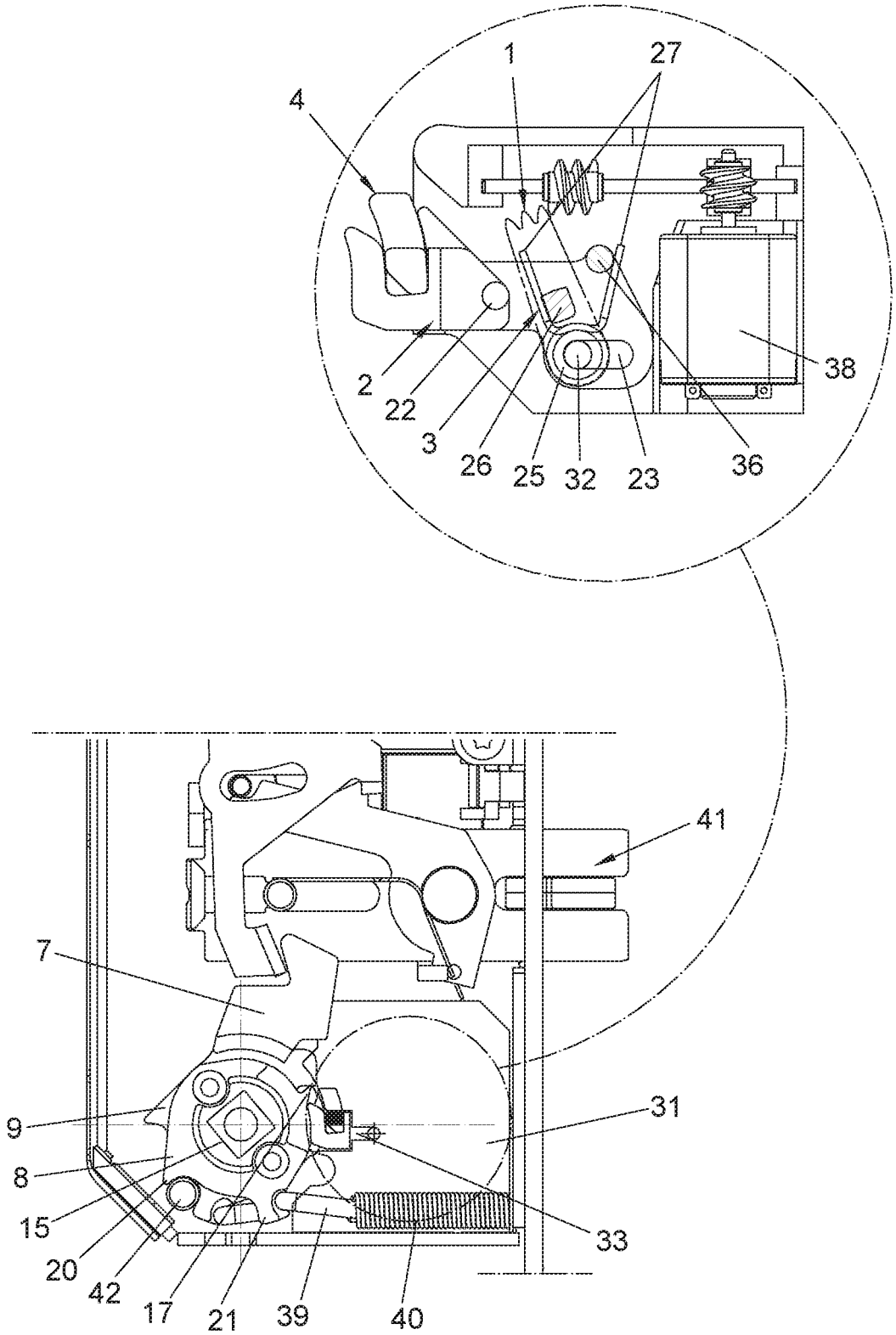
FIG. 12 shows a detailed cross-sectional view of the lock components in a situation of accumulated engagement.

One of these situations, shown in FIG. 12, takes place when the handle is rotated from the outer side of the room before introducing the correct access element, thus rotating the corresponding first lateral follower (8) and in this situation, with the handle rotated, the key (password, code, etc.) is introduced. Then, if the identification is validated, the electronic system sends a signal to the motor (38) which, upon activating, causes the actuation lever (1) to rotate by means of the transmission system.

In this situation the accumulator arm (2) cannot move towards the first lateral follower (8) since, as the first lateral follower (8) is rotated, the central web (28) of the clutch (4) makes contact with the push element (17), not allowing the clutch (4) to be introduced in the first lateral follower (8).

Then, by rotating the actuation lever (1) and the accumulator arm (2) not being able to move, the torsion accumulator spring (3) is loaded, having the second leg (27) displaced by the push of the prismatic projection (26) of the actuation lever (1) and the first leg (27) blocked, trying to move the push point (36) of the accumulator arm (2).

The moment that the handle is released and the first lateral follower (8) returns to the initial position thereof, the torsion accumulator spring (3) unloads, moving the accumulator arm (2) towards the first lateral follower (8) and positioning the clutch (4) in the operational position thereof.

Figure 13:
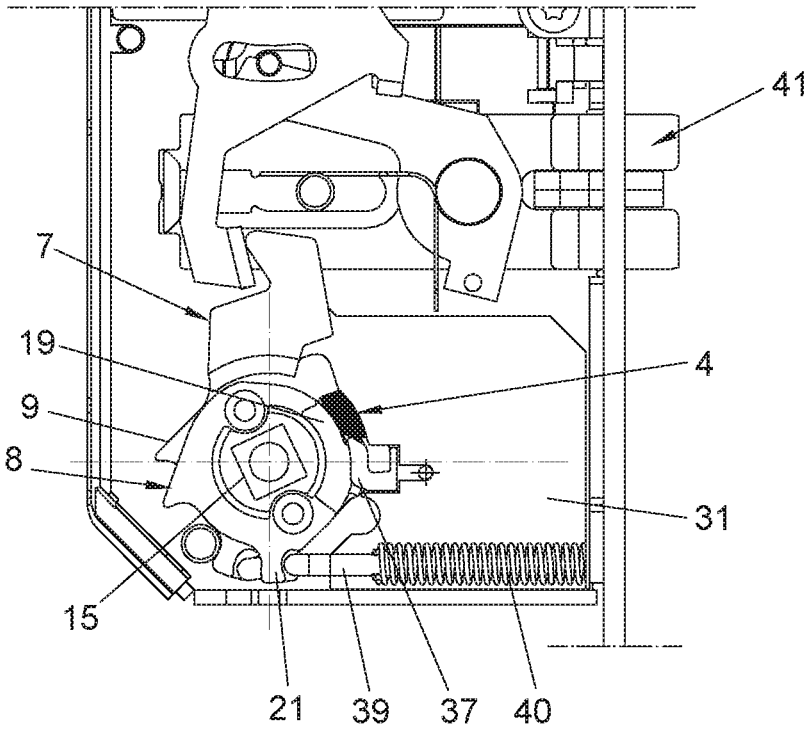
FIG. 13 shows a sectional view of the lock components in a situation of anomalous operation in the locking of the lock.

Another situation of anomalous operation that the lock of the present invention is able to resolve is when, once the lock is opened, the handle is not released and is kept in an opening position. This is the situation shown in FIGS. 13 and 14. In this case, the closure operation has taken place, the accumulator arm (2), after the opening, withdraws to the resting position thereof activated by the motor (38), the transmission system, the torsion accumulator spring (3) and the guide systems existing between the accumulator arm (2) and the support (31). However, the accumulator arm (2) does not carry along the clutch (4), as it is still withheld in the opening position thereof.

In this situation, once the handle is released, the positioning spring (40), by means of the spring guide (39) returns the first lateral follower (8) and the central follower (7) to the resting position, pushing the clutch (4) towards the location thereof in the accumulator arm (2). However, as they are in misaligned positions, the insertion of the clutch (4) into the accumulator arm (2) would not be secured.

In order to perform this motion, the forks (37) of the accumulator arm (2) present inclined inlet surfaces (35) and the projections (29) of the clutch (4) present inclined surfaces (30). When contact is made between the inlet surfaces (35) and the inclined surfaces (30), a wedge effect is generated pushing the accumulator arm (2) towards the operational position thereof, in other words, removing it from the resting position thereof and allowing the clutch (4) to be housed inside the accumulator arm (2), with the projections (29) located on the fork bases (34) of the forks (37).

As shown in FIG. 14, while the clutch (4) is introduced in the accumulator arm (2) by the wedge effect generated between the inlet surfaces (35) and the inclined surfaces (30), the accumulator arm (2) moves away from the resting position thereof but with the lock disengaged in a closure situation, so that the actuation lever (1) has not moved, maintaining the disengaged position thereof. This causes the torsion accumulator spring (3) to load, as one of the legs (27) thereof is in contact with the prismatic projection (26) of the stationary actuation lever (1) and the other leg (27) is in contact with the push point (36) of the accumulator arm (2), which makes the spring (3) load upon moving.

Once the clutch (4) is housed in the accumulator arm (2), the wedge effect ceases and the torsion accumulator spring (3) unloads, returning the accumulator arm (2) with the clutch (4) to the resting position thereof.

The configuration of the lock of the present invention allows the clutch (4) to be a mobile part, which is not permanently joined to any part making up the lock, and which moves inside the lock during the opening and closing phases, first linearly and then rotationally, with no problems in the movement thereof. This fact, together with what is described below, provides the lock with optimal security features against manipulation attempts of the same.

As described above, as far as the security improvements of the mortise lock with respect to the existing ones are concerned, in addition to the mobility of the clutch, the configuration and design of the parts making up the lock are key for the achievement of this purpose.

In this sense, the shape of the clutch (4), together with the shape of the forks (37) of the accumulator arm (2), the positioning of the clutch (4) in the accumulator arm (2), the prismatic projection (26) of the actuation lever (1), the push point (36) of the accumulator arm (2) and the torsion accumulator spring (3) are the elements in charge of providing the lock with this security.

The fact that the clutch (4) is, in resting position, in permanent contact with the surface of the forks (37) of the accumulator arm (2), together with the fact that the first leg (27) of the torsion accumulator spring (3) is in permanent contact with the prismatic projection (26) of the actuation lever (1) and the second leg (27) of the torsion accumulator spring (3) is in permanent contact with the push point (36)

of the accumulator arm (2), together with the fact that the actuation lever (1) is blocked by the transmission system and can only be moved when the motor (38) is activated, makes these elements unable to be moved in the event of manipulation attempts of the lock.

This configuration, with permanent contact between the aforementioned elements without gaps therebetween, makes it so that in the disengaged position the lock is hard to manipulate by means of vibrations and/or strikes, as these elements will never be able to be moved as they are joined to each other and in turn, joined to the motor (38) in charge of the motion. Likewise, the fact that the clutch needs a linear motion and subsequently a rotational motion inside the lock, further hinders the possibility of opening by means of this type of manipulation.

Lastly, it must be noted that the present invention must not be limited to the embodiment described herein. Other configurations may be carried out by those skilled in the art based on the present description. Accordingly, the scope of the invention is defined by the following claims.

The invention claimed is:

1. A symmetrical and reversible-clutch mortise lock comprising:

a central follower, a pair of symmetrical lateral followers, each one located on one side of the central follower, a spacer which makes the motion of the two lateral followers independent, and a motor, joined to a transmission system which engages with a toothed end of an actuation lever that is fixed, and able to rotate, on a support of the lock structure, wherein the lock further comprises:

an accumulator arm, able to move linearly over the lock structure activated by the actuation lever, that comprises a pair of forks, with an L-shaped configuration and with a base, in addition to a guide point and a guide groove which, respectively coupled to an additional guide groove and an additional guide point fixed to the support of the lock structure, configure the linear motion of the accumulator arm, a torsion accumulator spring, coupled to the actuation lever, comprising two legs between which a prismatic projection of the actuation lever and a push point of the accumulator arm are located, limiting the motion of the accumulator arm, and a clutch, housed in the accumulator arm, able to move integrally with it, wherein the lateral follower is configured to extract the clutch from the accumulator arm and move the clutch until it makes contact with a drag element of the central follower, so that a latch of the lock is activated, such that the clutch is free to be able to move both linearly and rotationally inside the lock.

2. The symmetrical and reversible-clutch mortise lock, according to claim 1, wherein the clutch is configured by means of a central web and two projections, each projection resting on a base of the fork of the accumulator arm.

3. The symmetrical and reversible-clutch mortise lock, according to claim 2, wherein the projections of the clutch have an inclined surface for introducing the clutch in the accumulator arm resting on inclined inlet surfaces present in the forks.

4. The symmetrical and reversible-clutch mortise lock, according to claim 1, wherein the lateral follower comprises a recess for the location of one of the forks, such that the lateral follower does not interfere with the forks in the movement of rotation of the clutch.

5. The symmetrical and reversible-clutch mortise lock, according to claim 1, wherein the lateral follower comprises two cylindrical holes located in alignment with elongated holes of the central follower for the location of at least a pin which fixes the lateral follower to the central follower and which allow the direct activation of the door latch from the side where the lateral follower which is fixed to the central follower is located.

6. The symmetrical and reversible-clutch mortise lock, according to claim 5, wherein the fixing of the lateral follower to the central follower is performed by means of an annular part which incorporates two pins.

7. The symmetrical and reversible-clutch mortise lock, according to claim 1, wherein it comprises a positioning spring, fixed to the support of the lock structure and to a pusher which makes contact with a projection of the lateral follower, by means of which the lateral follower is returned to the resting position thereof.

8. The symmetrical and reversible-clutch mortise lock, according to claim 1, wherein the push of the clutch by means of the lateral follower is caused by means of a push element.

9. The symmetrical and reversible-clutch mortise lock, according to claim 1, wherein the actuation lever comprises a cylindrical projection that is fixed, and able to rotate, on the additional guide point of the support of the structure, allowing the rotation of the actuation lever.

10. The symmetrical and reversible-clutch mortise lock, according to claim 1, wherein the lateral follower comprises a stop which makes contact with a rotation stop fixed to the lock structure by means of which the rotation motion for opening the lock is limited.

* * * * *